US005890260A

United States Patent [19]

Gaunt

[11] Patent Number: 5,890,260

[45] Date of Patent: Apr. 6, 1999

[54] HAND SAVER

[76] Inventor: John C. Gaunt, 3330 Longhorn Rd., Roanoke, Va. 24018

[21] Appl. No.: 828,879

[22] Filed: Mar. 31, 1997

Related U.S. Application Data

[60] Provisional application No. 60/020,708, Jul. 1, 1996.

[51] Int. Cl. [6] ..... B25G 1/10

[52] U.S. Cl. ..... 16/111 R; 16/DIG. 12; 206/223; 206/229

[58] Field of Search ..... 16/110 R, 111 R, 16/114 R, DIG. 12, 116 R; 206/223, 229

[56] References Cited

U.S. PATENT DOCUMENTS

| | | | |
|---|---|---|---|
| 616,746 | 12/1898 | Taylor | 16/111 R |
| 635,084 | 10/1899 | Taylor | 16/DIG. 12 |
| 1,980,655 | 11/1934 | Balistreri | 16/DIG. 12 |
| 2,789,729 | 4/1957 | Johnson | 206/229 |
| 2,984,486 | 5/1961 | Jones | 473/298 |
| 3,585,101 | 6/1971 | Stratton et al. | 16/111 R |
| 4,284,275 | 8/1981 | Fletcher | 473/549 |
| 4,875,251 | 10/1989 | Hazard | 16/111 R |
| 5,216,781 | 6/1993 | Brondfield | 16/114 R |
| 5,348,360 | 9/1994 | Mencurelli et al. | 16/114 R |
| 5,419,797 | 5/1995 | Ciamaga et al. | 206/223 |

FOREIGN PATENT DOCUMENTS

| | | | |
|---|---|---|---|
| 2185209 | 7/1987 | United Kingdom | 16/111 R |

OTHER PUBLICATIONS

"Get a Grip" in *Today's Homeowner,* vol. 94, No. 826 p. 87, Jun. 1998.

*Primary Examiner*—Chuck Y. Mah
*Assistant Examiner*—Donald M. Gurley
*Attorney, Agent, or Firm*—Woods, Rogers & Hazlegrove, PLC; C. Fred Rosenbaum

[57] ABSTRACT

A safety device made of soft conformable cushioning material to be formed about the handle of manual work implements or tools to protect the hands of the user. The material is brightly colored to attract the eye and prevent the loss or misplacement of the tools. The material may be a polymer or rubber foam with or without a smooth outer surface. The user of any hand tool can modify the tool with the safety material by measuring, cutting and trimming to fit, then attaching the material to the handle of the tool by an adhesive.

6 Claims, 1 Drawing Sheet

HAND SAVER

This is a continuation of the provisional application, Ser. No. 60/020,708 filed Jul. 1, 1996.

BACKGROUND OF THE INVENTION

The present invention relates to manual tools and will particularly pertain to the new and improved safety attachment to the portions of the tool, usually referred to as the handle, contacted by the hands of the user during the use of the tool.

The frequency and the dangers of misplaced tools is so prevalent that comic relief is given to the situation. How many cartoon and real life characters have stepped on the upturned rake or hoe to their mortification! While this is funny when there is no permanent damage, it only happens in the movies. Serious injury about the home and work site is a major problem and usually includes the use of tools. One major concern addressed by this invention is safety.

For example, a hammer or rake or shovel or hoe or pick or hedge clippers laying in the yard or about any work place pose real dangers because the normal coloration of the tool blends into the background. The wooden handles of these tools takes on a brown or tan color and the blades or tines are most always rust colored. These things become unguided missiles when run over by other machinery, such as rotary mowers. The possibility of accidently stepping on these tools is also increased by their camouflage.

Further, it is not necessarily forgetfulness that the tools are left in the work place. The blending of the tool into its background leads to loss through a lack of visibility. In a construction environment, where there are many workers handling several different manual tools, the loss of the tools through misplacement is a significant cost.

The use of hand tools produces significant friction between the user's hands and the handle of the implement. The wooden or metal handles of hand tools become difficult to control when they become wet during use sometimes creating accidents and injury through misdirection of the tool. The occasional users of such equipment may incur injuries to the hands, if not sufficiently protected. Conventional protection includes work gloves which, in themselves, are a source of irritation whether it is forgetting to carry them or the heat or perspiration resulting from their use. The hand injuries resulting from the use of hand tools include blisters, sprains, strains, and general soreness produced by the shock transmitted by the tools to the hands. Several patents show hand tools with various protective devices attached to the handles, e.g. U.S. Pat. Nos. 4,832,132; 4,089,379; 4,054,313; 3,981,043; 3,874,686; 3,237,950; 1,976,411; 1,942,493; 1,752,064; 1,632,227; and 1,248,445.

SUMMARY OF THE INVENTION

In view of the foregoing disadvantages inherent in the known hand tools, the present invention provides an improved protective device wherein the device is mounted on the tool, producing an attention attracting image when the tool is not in use and a cushioning and shock absorbing thickness during manipulation of the tool.

To attain this, the hand saver comprises a blank of a plastic foam. The foam material may be provided in various thicknesses for use on the handles of different tools. The hand saver is a kit made up of pre-forms to provide protection to vastly different handles, such as a paint brush or a broom. The foam is colored with the florescent safety colors, such as bright orange, chartreuse, yellow or red, preferably, but any distinctive color is acceptable. It is not the intention of this disclosure to limit the uses of this device to some number or types of tools. This device may be adapted to any tool that the user decides to modify to provide the safety inherent in the use of this device.

The foam pre-forms provided in the kit can be easily manipulated to conform to the size and shape of a particular conventional tool handle. Once this has been done, the foam is trimmed to a snug fit about the handle. Then the foam is trimmed of excess material for smoothness of the overall application. Adhesive is then applied to the pre-form to produce the final form of the hand saver. The adhesive may be a reactive type that bonds by chemical reaction in the foam to bond the foam to itself or it may be, merely, an adhesive applied to edges of the pre-form and bonds to itself. The adhesive may be applied to the handle of the tool to provide a greater amount of attachment between the handle and the hand saver.

DESCRIPTION OF THE PREFERRED EMBODIMENT

Figure 1:
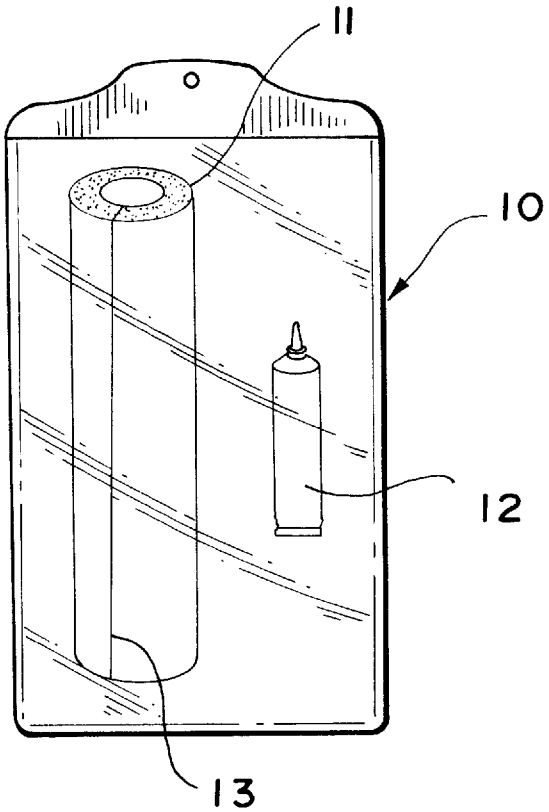
FIG. 1 perspective of a hand saver kit.

As shown in FIG. 1, the hand saver kit 10 contains, at least one tubular pre-form 11, which may be approximately 30 inches in length and a container of adhesive 12. The pre-form 11 is a unitary piece of polymer foam which has been rolled about a mandrel and the edges butt seamed together 13. The pre-form also can be formed as a unitary element without a seam. Since the diameter of the handles of long handled tools, e.g. picks, shovels, mattocks, hoes, rakes, is approximately the same and the foam is somewhat elastic, one pre-form may be capable of being applied to several different tools. However, the kit 10 could include an assortment of pre-forms of varying diameters. Smaller diameter pre-forms are provided for attachment to lighter tools, e.g. brooms, mops, brushes, etc.. The foam has a thickness that provides a cushioning effect when gripped by the user. When the hand saver is applied to a particular implement, it should not be forced onto a handle with a diameter that would unduly stretch the foam to eliminate the cushioning effect.

Figure 3:
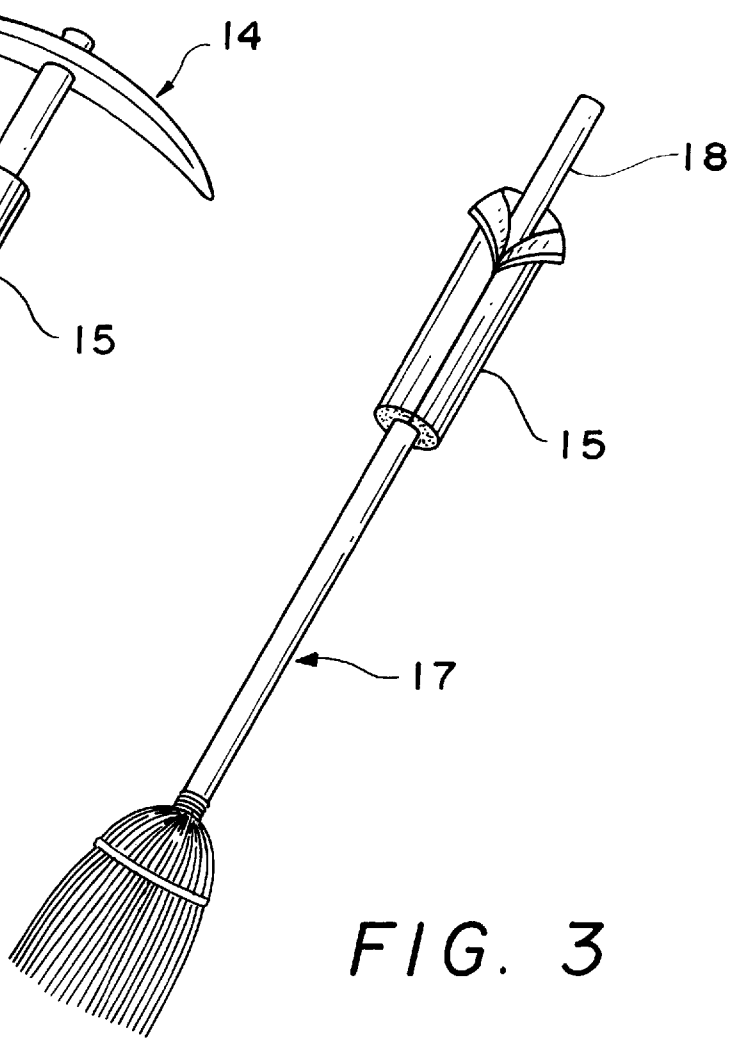
FIG. 3 shows the pre-form placed about a handle and partially trimmed away.
Figure 2:
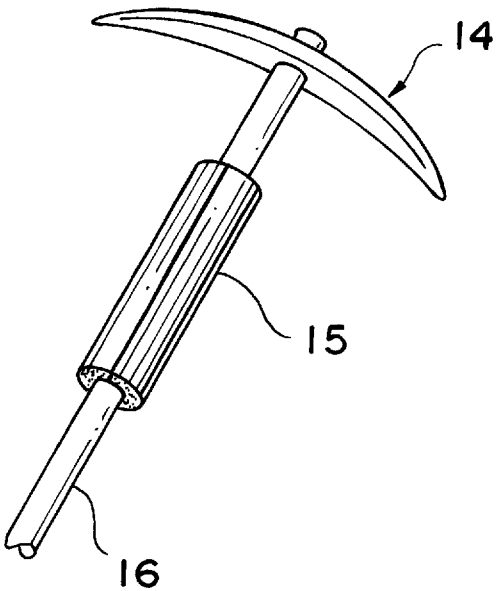
FIG. 2 shows a perspective of a pick with the hand saver applied.

FIG. 2 shows a pick 14 with the hand saver 15 applied to the handle 16. The pre-form may be applied to the handle without adhesive being used to bond the implement and the hand saver together. But on heavy tools that depend on a slinging motion to perform the work, e.g. axes and picks, an adhesive bond should be used. This can be accomplished in two ways; the adhesive can be applied to the pre-form and to the handle, then the pre-form is rolled or slipped onto the handle or the hand saver may be trimmed to the proper diameter and length, adhesive applied to the handle and the hand saver, then the hand saver is affixed to the implement using the handle as a mandrel. FIG. 3 shows a broom 17 with the hand saver 15 partially affixed to the handle 18. The edge of the hand saver has been trimmed to adjust the diameter to the implement resulting in a smooth surface at the seam. In this instance, the adhesive is applied to the edges of the hand saver and to the handle of the implement thereby forming the hand saver directly on the implement.

The hand saver has the additional safety feature of florescent coloring to attract attention to the implement. By visually signaling the location of the discarded implement so that the implement does not blend into the surrounding environment, accidental contact or loss may be prevented.

I claim:

1. A kit for applying a safety and protective covering means to the handle of a manual tool comprising a package containing a plurality of foam preforms of different sizes, said foam preforms having a florescent color, said color being one of the group consisting of red, orange, chartreuse or yellow, and a container of adhesive, said adhesive adapted to be applied to said preforms forming an integral safety and protective covering means about the handle of said tool, said safety and protective covering means providing a cushioning effect on said handle of said tool and a visually enhanced indication of the location of said manual tool.

2. A kit as claimed in claim 1 wherein said foam preforms have a tubular configuration.

3. A kit as claimed in claim 2 wherein said adhesive is applied to said tubular preforms and said handle.

4. A kit as claimed in claim 1 wherein said foam preforms comprise a cellular material selected from the group consisting of rubber and polymer plastic material.

5. A kit as claimed in claim 1 wherein said adhesive is of a material that forms an autogenous bond in said foam preform.

6. A kit as claimed in claim 1 wherein said foam preforms have a smooth outer surface.

* * * * *